US011796934B2

(12) United States Patent
Yasuda

(10) Patent No.: US 11,796,934 B2
(45) Date of Patent: Oct. 24, 2023

(54) IMAGE FORMING APPARATUS

(71) Applicant: CANON KABUSHIKI KAISHA, Tokyo (JP)

(72) Inventor: Shinya Yasuda, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/975,701

(22) Filed: Oct. 28, 2022

(65) Prior Publication Data

US 2023/0152727 A1 May 18, 2023

(30) Foreign Application Priority Data

Nov. 12, 2021 (JP) ..... 2021-184723

(51) Int. Cl.
*G03G 15/02* (2006.01)
*G03G 21/18* (2006.01)

(52) U.S. Cl.
CPC ..... *G03G 15/0258* (2013.01); *G03G 21/1814* (2013.01); *G03G 21/1842* (2013.01)

(58) Field of Classification Search
CPC ..... G03G 15/0225; G03G 15/0258; G03G 15/0291; G03G 21/1814; G03G 21/1821; G03G 21/1842
See application file for complete search history.

(56) References Cited

U.S. PATENT DOCUMENTS

| | | | | |
|---|---|---|---|---|
| 9,389,583 | B2 | 7/2016 | Maeda et al. | |
| 11,675,306 | B2 * | 6/2023 | Shiina | G03G 21/1619 399/110 |
| 2013/0164023 | A1 * | 6/2013 | Shimizu | G03G 15/0291 399/111 |
| 2022/0113648 | A1 * | 4/2022 | Sueshige | G03G 15/0291 |

FOREIGN PATENT DOCUMENTS

| | | | |
|---|---|---|---|
| JP | H0525456 | U | 4/1993 |
| JP | 2002304046 | A | 10/2002 |
| JP | 2013076925 | A | 4/2013 |
| JP | 2015141247 | A | 8/2015 |

* cited by examiner

*Primary Examiner* — Hoang X Ngo
(74) *Attorney, Agent, or Firm* — ROSSI, KIMMS & McDOWELL LLP

(57) ABSTRACT

In a case where a cleaning member is located at a cleaning position in attachment of a process cartridge to an image forming apparatus, a stopper located at a first position butts against the process cartridge guided in a direction of attachment by a guide portion such that the process cartridge is disabled from being attached to the image forming apparatus, and in a case where the cleaning member is located at a retraction position in attachment of the process cartridge to the image forming apparatus, a lever portion moves due to a press by a cleaning unit and the stopper moves from the first position to a second position such that the process cartridge is enabled to be attached to the image forming apparatus.

5 Claims, 7 Drawing Sheets

IMAGE FORMING APPARATUS

BACKGROUND OF THE INVENTION

Field of the Invention

The present invention relates to an image forming apparatus, such as an electrophotographic copying machine or a printer, to which a process cartridge is detachably attached.

Description of the Related Art

Japanese Patent Application Laid-Open No. 2013-076925 discloses an image forming apparatus to which a cartridge is detachably attached, the cartridge including a cleaning member that cleans a discharge member, such as a discharge wire. Such a cartridge attached to the image forming apparatus in Japanese Patent Application Laid-Open No. 2013-076925 includes a photoconductor on which an electrostatic latent image is to be formed, a discharge member extending along the photoconductor opposite the photoconductor, and a cleaning unit that moves along the extending direction of the discharge member, to clean the discharge member. The cleaning unit includes a body portion movable along the extending direction of the discharge member and an operation portion protruding graspably from the body portion.

However, according to Japanese Patent Application Laid-Open No. 2013-076925, if the cleaning unit has not moved to the standby position at an end portion of the cartridge at the time of cleaning of the discharge wire, the cleaning unit blocks the optical path of a laser. According to Japanese Patent Application Laid-Open No. 2013-076925, with the cleaning unit blocking the optical path of the laser, the apparatus itself can operate. In this case, as a problem, no image is acquired at a part at which the optical path of the laser is blocked in image output.

SUMMARY OF THE INVENTION

It is desirable to disable, in a case where a cleaning member that cleans a charge member is located at any cleaning position in attachment of a process cartridge to an image forming apparatus, attachment of the process cartridge to the image forming apparatus.

According to one aspect of the present invention, provided is an image forming apparatus including: a process cartridge attachable to the image forming apparatus, the process cartridge including: a photoconductive drum; a charge member configured to charge the photoconductive drum; and a cleaning unit including: a cleaning member configured to clean the charge member; and an operation portion to be operated by a user in order to move the cleaning member between a cleaning position for cleaning the charge member and a retraction position for retraction from the cleaning position; a guide portion configured to guide the process cartridge in a direction of attachment to the image forming apparatus; a stopper configured to butt against the process cartridge guided in the direction of attachment by the guide portion, to restrict movement of the process cartridge in the direction of attachment; and a lever portion connected to the stopper, the lever portion being configured to move together with the stopper, in which the stopper is movable between a first position that butts against the process cartridge guided in the direction of attachment by the guide portion and a second position that does not butt against the process cartridge guided in the direction of attachment by the guide portion, in a case where the cleaning member is located at the cleaning position in attachment of the process cartridge to the image forming apparatus, the stopper located at the first position butts against the process cartridge guided in the direction of attachment by the guide portion such that the process cartridge is disabled from being attached to the image forming apparatus, and in a case where the cleaning member is located at the retraction position in attachment of the process cartridge to the image forming apparatus, the lever portion moves due to a press by the cleaning unit and the stopper moves from the first position to the second position such that the process cartridge is enabled to be attached to the image forming apparatus.

Further features of the present invention will become apparent from the following description of exemplary embodiments (with reference to the attached drawings).

DESCRIPTION OF THE EMBODIMENTS

Figure 1:
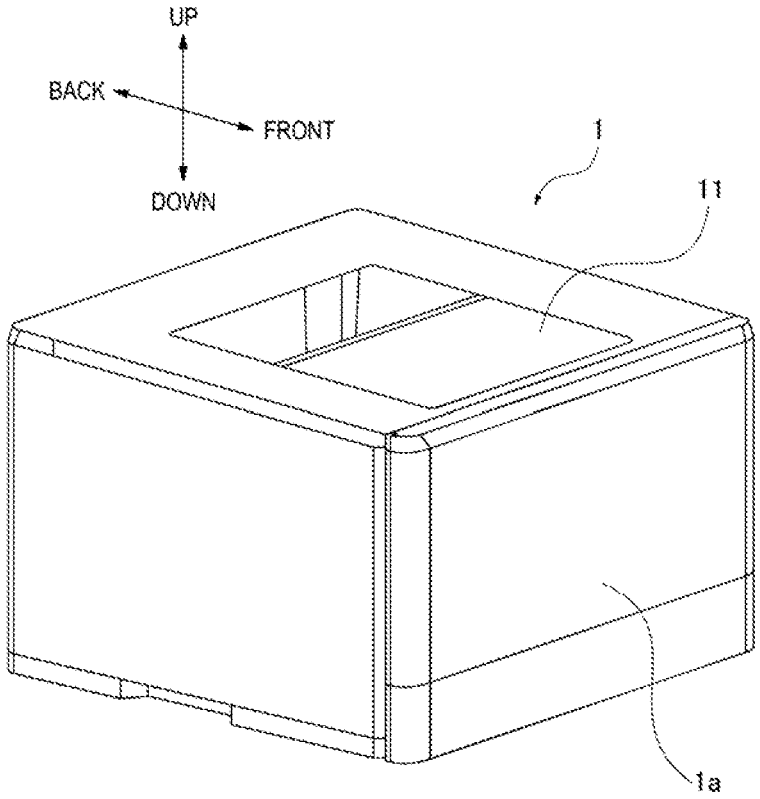
FIG. 1 is a perspective view of an image forming apparatus according to an embodiment of the present invention.

An embodiment will be described in detail below with reference to the drawings.

<Configuration of Image Forming Apparatus>

The configuration of an image forming apparatus 1 according to the embodiment of the present invention will be described in detail with reference to FIGS. 1 to 4 and FIGS. 6A and 6B.

The image forming apparatus 1 includes an apparatus body 1*a*, a CRG cover 11, a blocking member 21, a spring 22, an upper support member 23*a*, a lower support member 23*b*, an LED exposure unit 40, and a process cartridge 50. The image forming apparatus 1 further includes a conveying roller 70, a sheet conveying belt 73, transfer rollers 74*y*, 74*m*, 74*c*, and 74*k*, a fixing unit 80, and a pair of discharge rollers 91.

The apparatus body 1*a* has a CRG guide 60 as a guide recessed portion at which the inside of the apparatus body 1*a* is exposed outward. The CRG guide 60 as a guide portion has a function of guiding the process cartridge 50 for attachment to the apparatus body 1*a*.

The CRG cover 11 as a cover is openably attached to the apparatus body 1*a* of the image forming apparatus 1. When remaining closed, the CRG cover 11 is loaded with a sheet P as a recording material discharged by the pair of discharge rollers 91. With the process cartridge 50 attached to the image forming apparatus 1, the CRG cover 11 is located right above the process cartridge 50 in a vertical direction.

Figure 2:
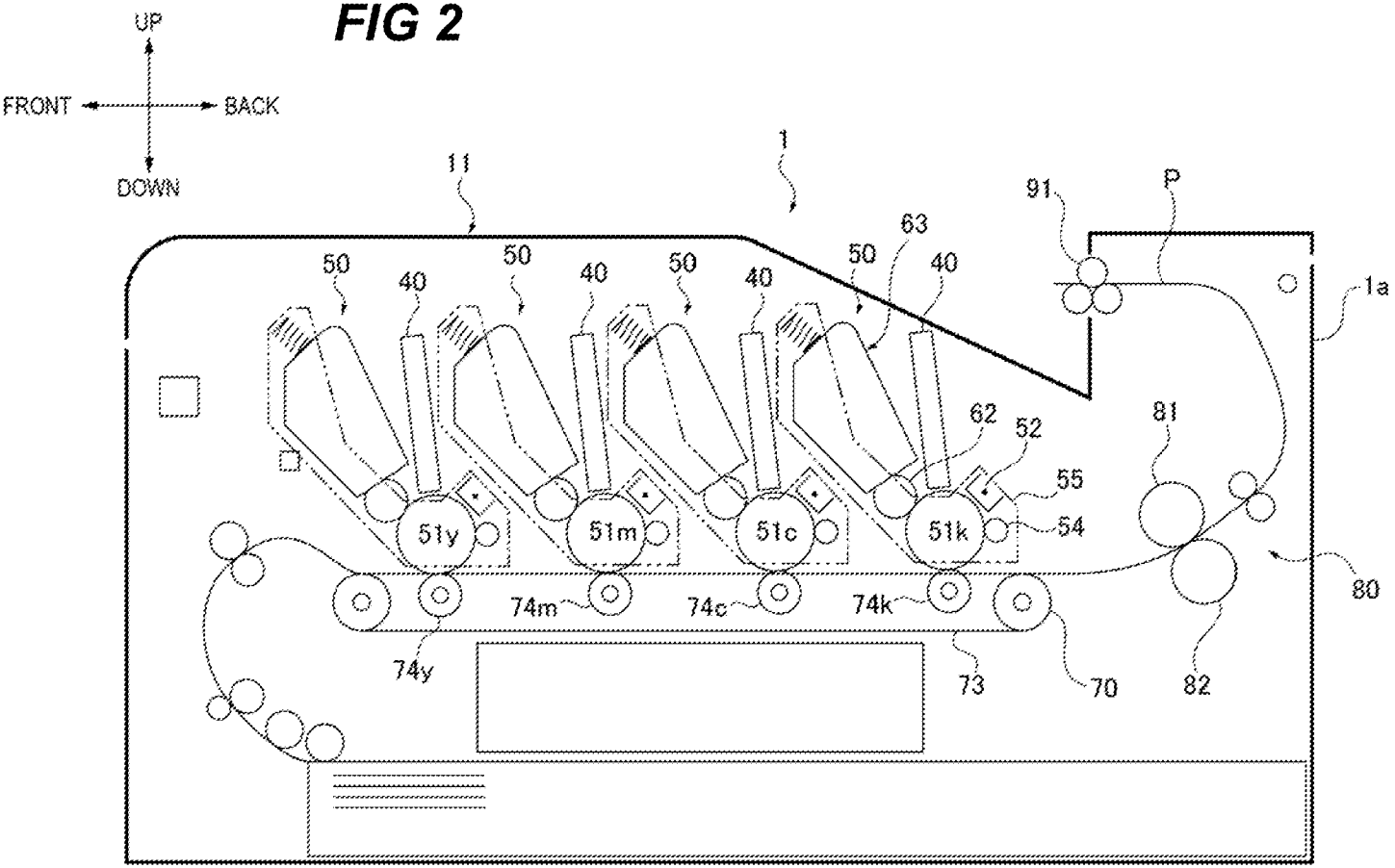
FIG. 2 is a schematic view of the image forming apparatus according to the embodiment of the present invention with a CRG cover closed.
Figure 3:
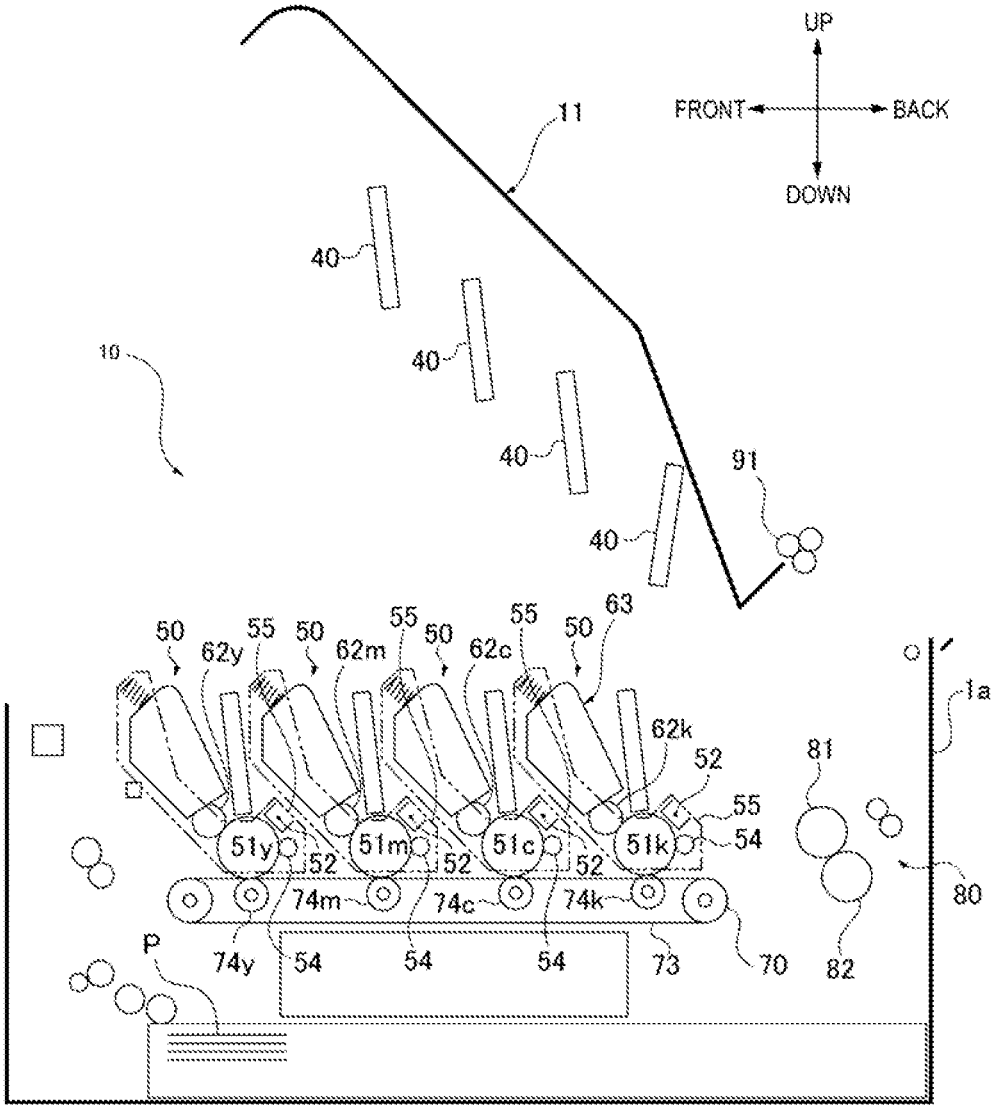
FIG. 3 is a schematic view of the image forming apparatus according to the embodiment of the present invention with the CRG cover opened.
Figure 4:
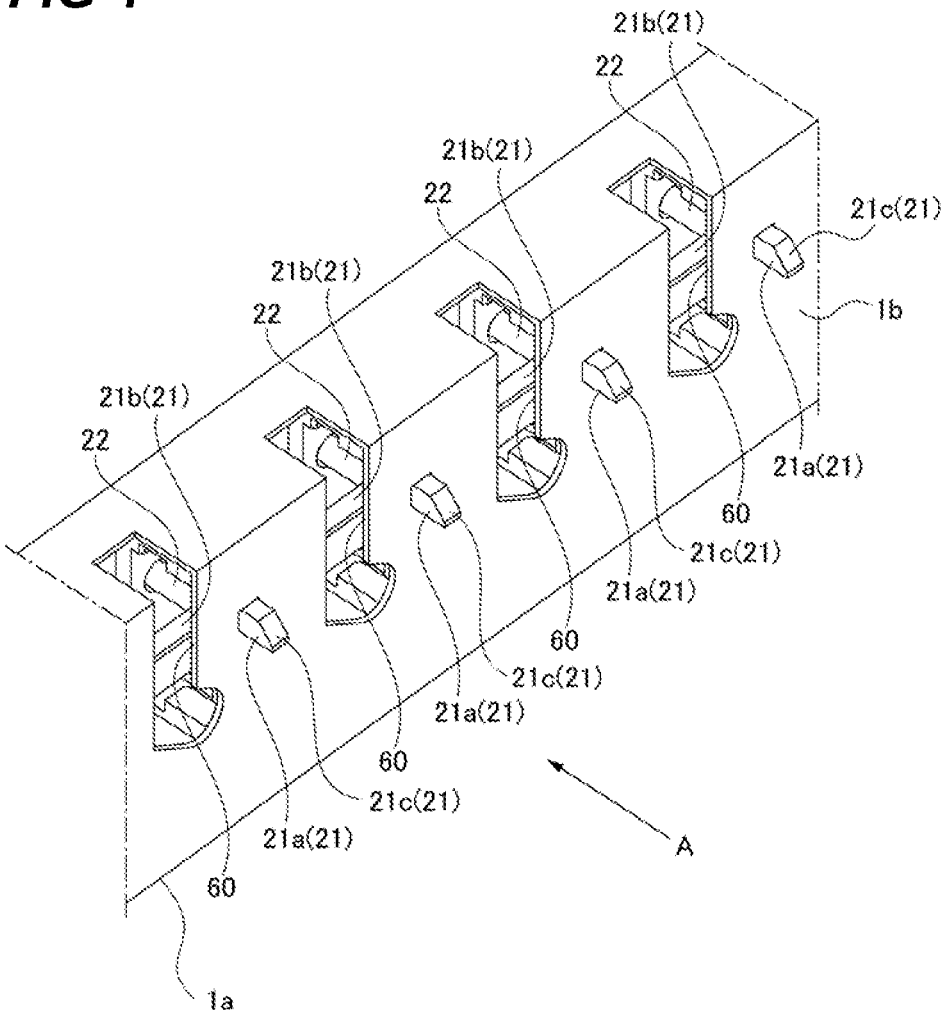
FIG. 4 is an enlarged perspective view of part of the image forming apparatus according to the embodiment of the present invention.

The blocking member 21 blocks attachment of the process cartridge 50 to the apparatus body 1*a* in a case where an operation portion 240 of a cleaning unit 200, to be described below, is located out of a retraction position in the process cartridge 50. Such blocking members 21 are provided one-to-one at CRG guides 60. Note that no blocking members 21 are illustrated in FIGS. 1 to 3. The configuration of a blocking member 21 will be described in detail below.

Figure 6A:
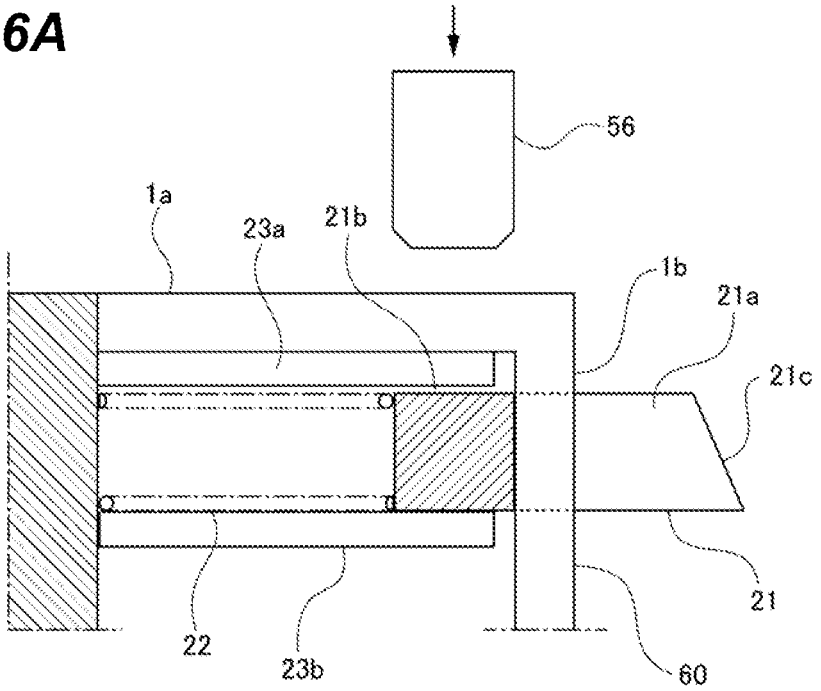
FIGS. 6A and 6B are each an enlarged sectional schematic view of part of the image forming apparatus according to the embodiment of the present invention.

As illustrated in FIG. 6A, the spring 22 as a biasing member has applied a force to the blocking member 21 in the direction in which part of the blocking member 21 protrudes outward from the apparatus body 1*a*.

Figure 6B:
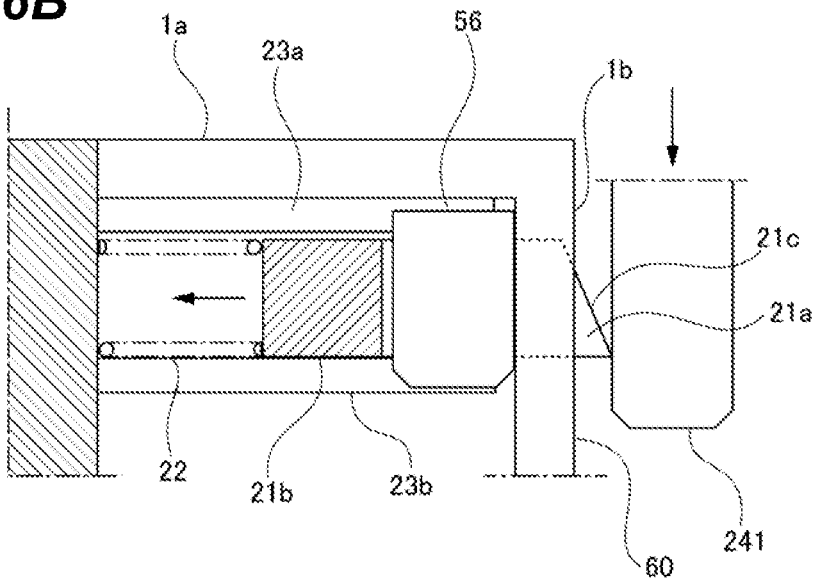

As illustrated in FIGS. 6A and 6B, the upper support member 23*a* is provided inside the apparatus body 1*a* and extends in the slide direction of the blocking member 21 above the blocking member 21. The upper support member 23*a* is not exposed outward from the CRG guide 60 when viewed in the direction of A in FIG. 4.

As illustrated in FIGS. 6A and 6B, the lower support member 23*b* is provided inside the apparatus body 1*a* and extends in the slide direction of the blocking member 21 below the blocking member 21. The lower support member 23*b* is not exposed outward from the CRG guide 60 when viewed in the direction of A in FIG. 4.

The LED exposure unit 40 irradiates the surface of a photoconductive drum 51*y*, 51*m*, 51*c*, or 51*k* with light based on an image signal, to form an electrostatic latent image.

Above the sheet conveying belt 73, a plurality of process cartridges 50 is attached along the front-back direction parallel to the conveying direction of a sheet P. Herein, exemplarily, the number of attachable process cartridges 50 is four. Referring to FIG. 3, with the CRG cover 11 opened, each process cartridge 50 is detachably attachable to the apparatus body 1*a* through an opening 10 and thus is replaceable. Note that the configuration of such a process cartridge 50 will be described in detail below.

Due to driving of a motor not illustrated, the conveying roller 70 drives rotationally to rotate the sheet conveying belt 73 clockwise in FIG. 2.

The sheet conveying belt 73 as a conveying member conveys a sheet P in synchronization with the respective color toner images formed on the photoconductive drums 51*y*, 51*m*, 51*c*, and 51*k*.

The transfer rollers 74*y*, 74*m*, 74*c*, and 74*k* are provided inside the sheet conveying belt 73. Due to application of voltage, the transfer rollers 74*y*, 74*m*, 74*c*, and 74*k* transfer, in sequence, the color toner images formed on the photoconductive drums 51*y*, 51*m*, 51*c*, and 51*k*, respectively, to the sheet P being conveyed on the sheet conveying belt 73.

The fixing unit 80 includes a fixing roller 81 including a built-in heater not illustrated and a pressure roller 82. The fixing unit 80 applies heat and pressure with the fixing roller 81 and the pressure roller 82 to the sheet P having the toner images transferred by the transfer rollers 74*y*, 74*m*, 74*c*, and 74*k*, so that the toner images are fixed to the sheet P. The fixing unit 80 conveys the sheet P having the toner images fixed thereto to the pair of discharge rollers 91.

The pair of discharge rollers 91 discharges the sheet P conveyed by the fixing unit 80 onto the CRG cover 11.

<Configuration of Process Cartridge>

The configuration of a process cartridge 50 for the image forming apparatus 1 according to the embodiment of the present invention will be described in detail with reference to FIGS. 5A and 5B.

Figure 5A:
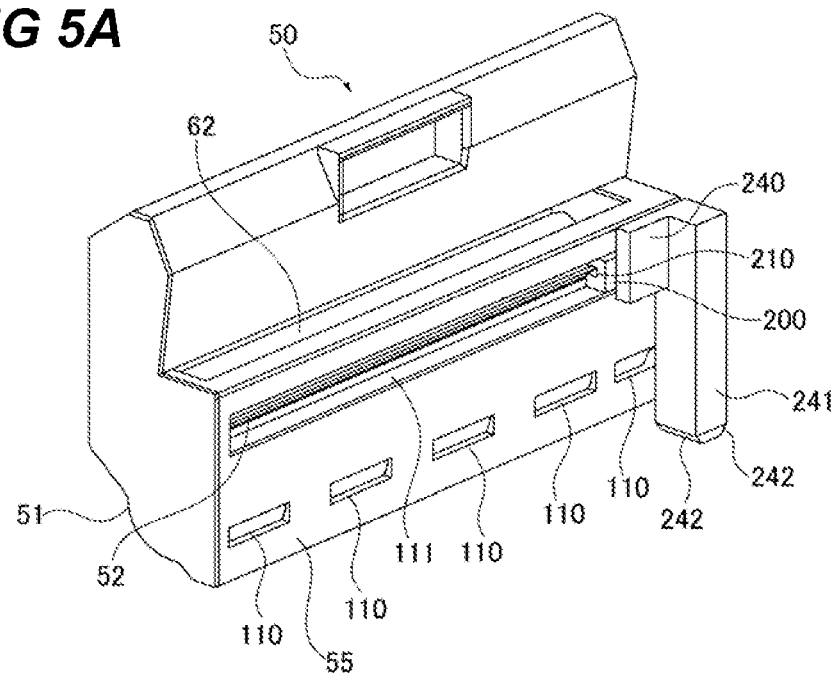
FIGS. 5A and 5B are each a perspective view of a process cartridge according to the embodiment of the present invention.
Figure 5B:
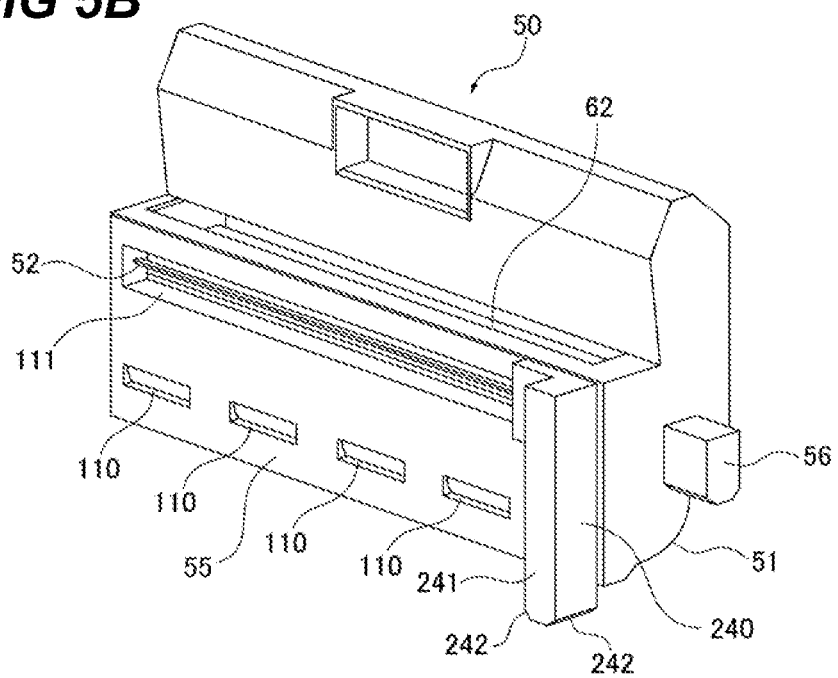

FIGS. 5A and 5B are each a perspective view of a process cartridge 50.

The process cartridge 50 includes a photoconductive drum 51*y*, 51*m*, 51*c*, or 51*k*, a retainment roller 54, a charge unit 55, a guide protruding portion 56, and a development roller 62.

Such process cartridges 50 are attached such that photoconductive drums 51*y*, 51*m*, 51*c*, and 51*k* are arrayed in the front-back direction. The photoconductive drums 51*y*, 51*m*, 51*c*, and 51*k* each drive rotationally counterclockwise at a predetermined rate in FIG. 2.

Such retainment rollers 54 are provided one-to-one to the photoconductive drums 51*y*, 51*m*, 51*c*, and 51*k*, and are each a member including a metallic rotary shaft covered with a roll body that is conductive and foam-elastic. Each retainment roller 54 collects and temporarily retains toner remaining on the surface of the corresponding photoconductive drum 51*y*, 51*m*, 51*c*, or 51*k* after transfer. At the time of cleaning, each retainment roller 54 returns the retained toner to the corresponding photoconductive drum 51*y*, 51*m*, 51*c*, or 51*k*. Note that the respective toners returned to the photoconductive drums 51*y*, 51*m*, 51*c*, and 51*k* are transferred to the sheet conveying belt 73, leading to collection by a cleaning unit not illustrated.

The charge unit 55 includes a charge wire 52, a vent 110, a vent 111, a cleaning unit 200, and a counter electrode not illustrated, and charges the surface of the photoconductive drum 51*y*, 51*m*, 51*c*, or 51*k*, uniformly.

The charge wire 52 serves as a metallic wire that generates corona discharge in response to application of a predetermined voltage. The charge wire 52 is disposed opposite the photoconductive drum 51*y*, 51*m*, 51*c*, or 51*k* above the photoconductive drum 51*y*, 51*m*, 51*c*, or 51*k*, and extends along the axial direction of the photoconductive drum 51*y*, 51*m*, 51*c*, or 51*k* (right-and-left direction).

The charge wire 52 as a charge member corresponds to a tabular electrode in a substantially U shape, in side view, opposite the counter electrode not illustrated. The counter electrode includes a grid electrode located between the charge wire 52 and the photoconductive drum 51*y*, 51*m*, 51*c*, or 51*k*, and a pair of shield electrodes located ahead of and behind the charge wire 52.

The vent 110 serves as an air inlet that guides air outside the charge unit 55 to the charge wire 52.

The vent 111 serves as a guide enabling movement of the cleaning unit 200 and as an outlet for discharging air around the charge wire 52. The vent 111 extends along the right-and-left direction identical to the extending direction of the charge wire 52.

The guide protruding portion 56 protrudes from a side face of the process cartridge 50 in the direction orthogonal to the direction of attachment to the apparatus body 1*a*.

Development rollers 62*y*, 62*m*, 62*c*, and 62*k* are capable of supplying toner to the photoconductive drum 51*y*, 51*m*, 51*c*, and 51*k*, respectively. The development rollers 62*y*, 62*m*, 62*c*, and 62*k* each regulate, together with a thickness-regulation blade not illustrated, toner supplied by a supply roller not illustrated from a storage portion 63, to a certain thickness, and bears and conveys the regulated toner having the certain thickness. The development rollers 62*y*, 62*m*, 62*c*, and 62*k* each develop, with the borne toner, an electrostatic latent image formed on the corresponding photoconductive drum 51*y*, 51*m*, 51*c*, or 51*k*, resulting in formation of a toner image on the corresponding photoconductive drum 51*y*, 51*m*, 51*c*, or 51*k*.

<Configuration of Cleaning Unit>

The configuration of a cleaning unit 200 for a process cartridge 50 for the image forming apparatus 1 according to the embodiment of the present invention will be described in detail with reference to FIGS. 5A and 5B.

The cleaning unit 200 corresponds to a member that is attached to a process cartridge 50 and cleans the charge wire 52. The cleaning unit 200 includes a wire cleaner 210 and an operation portion 240.

The wire cleaner 210 wipes out foreign matter adhering to the charge wire 52, in sliding contact with the charge wire 52 in the vent 111.

The operation portion 240 is capable of moving along the vent 111 in response to an operation from a user and includes a protruding portion 241. Referring to FIGS. 5A and 5B, the protruding portion 241 protrudes downward from the process cartridge 50 in the direction of attachment to the apparatus body 1*a*. The protruding portion 241 has an inclined face 242 at its lower end as a leading end in the protruding direction.

In response to a left-and-right operation from the user to the operation portion 240, the cleaning unit 200 having such a configuration as above cleans the entire region, which is necessary for charge of the photoconductive drum 51*y*, 51*m*, 51*c*, or 51*k*, in the charge wire 52.

In this case, referring to FIGS. 5A and 5B, movement of the cleaning unit 200 to the right end of the process cartridge 50 causes the cleaning unit 200 to be located out of a charge range necessary at the time of image forming with the photoconductive drum 51*y*, 51*m*, 51*c*, or 51*k*. The cleaning unit 200 located out of the charge range does not block the optical path of a laser emitted from the LED exposure unit 40 to the photoconductive drum 51*y*, 51*m*, 51*c*, or 51*k*. The location is defined as the retraction position of the cleaning unit 200.

The cleaning unit 200 located within the charge range blocks the optical path of a laser emitted from the LED exposure unit 40 to the photoconductive drum 51*y*, 51*m*, 51*c*, or 51*k*. The location is defined as the cleaning position of the cleaning unit 200.

<Configuration of Blocking Member>

The configuration of a blocking member 21 in the image forming apparatus 1 according to the embodiment of the present invention will be described in detail with reference to FIGS. 4, 6A, 6B, and 7.

FIG. 6A illustrates a cleaning-unit detecting portion 21*a* having not been pressed by a protruding portion 241. FIG. 6B illustrates the cleaning-unit detecting portion 21*a* having been pressed by the protruding portion 241.

A blocking member 21 includes a cleaning-unit detecting portion 21*a* and a CRG stopper 21*b*.

The cleaning-unit detecting portion 21*a* as a lever portion is connected to the CRG stopper 21*b* and moves together with the CRG stopper 21*b*. The cleaning-unit detecting portion 21*a* has received the force applied by the spring 22 through the CRG stopper 21*b* in the direction of protrusion from the apparatus body 1*a* (right direction in FIG. 6A) and protrudes slidably from an attachment face 1*b* for a process cartridge 50 of the apparatus body 1*a*. The protruding direction of the cleaning-unit detecting portion 21*a* is opposite to the retracting direction of the blocking member 21 (direction of A in FIG. 4). The retracting direction of the blocking member 21 is orthogonal to the direction of attachment of a process cartridge 50 to the apparatus body 1*a*.

The cleaning-unit detecting portion 21*a* protrudes, between adjacent process cartridges 50, from the attachment face 1*b* for a process cartridge 50 of the apparatus body 1*a*. With the cleaning unit 200 located at the retraction position, the cleaning-unit detecting portion 21*a* is located opposite the protruding portion 241. The cleaning-unit detecting portion 21*a* has an inclined face 21*c* inclining downward at its leading end in the protruding direction of the cleaning-unit detecting portion 21*a*.

The CRG stopper 21*b* is provided inside the apparatus body 1*a* and has received the force applied by the spring 22 in the right direction in FIG. 6A. The CRG stopper 21*b* is disposed between the upper support member 23*a* and the lower support member 23*b*. Due to the upper support member 23*a* and the lower support member 23*b*, the CRG stopper 21*b* is guided for a slide in the direction of A in FIG. 4 identical to the retracting direction of the CRG stopper 21*b* or in the opposite direction to the direction of A. The CRG stopper 21*b* slides together with the cleaning-unit detecting portion 21*a*. The CRG stopper 21*b* butts against the process cartridge 50 guided in the direction of attachment by the CRG guide 60, to restrict movement in the direction of attachment of the process cartridge 50.

<Operation of Attachment of Process Cartridge to Apparatus Body>

The operation of attachment of a process cartridge 50 to the apparatus body 1*a* of the image forming apparatus 1 according to the embodiment of the present invention will be described in detail with reference to FIGS. 4 to 7.

The operation of attachment of a process cartridge 50 to the apparatus body 1*a* with the cleaning unit 200 located at the retraction position will be described.

First, the guide protruding portion 56 of the process cartridge 50 is inserted, from above, into a CRG guide 60 in the apparatus body 1*a*.

Then, the guide protruding portion 56 moves downward while being guided by the CRG guide 60. In this case, with the cleaning unit 200 of which the inclined face 242 of the protruding portion 241 abuts on the inclined face 21*c* of the cleaning-unit detecting portion 21*a*, the cleaning-unit detecting portion 21*a* is pushed inside the apparatus body 1*a* against the force applied by the spring 22.

Figure 7:
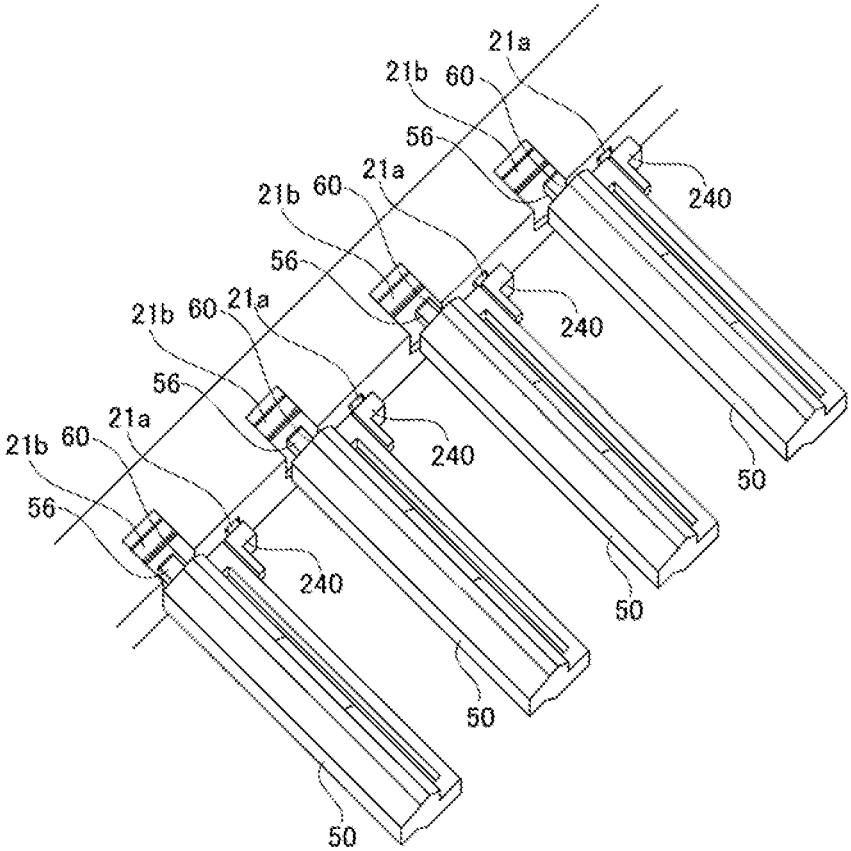
FIG. 7 is a perspective view of process cartridges attached to the image forming apparatus according to the embodiment of the present invention.

The cleaning-unit detecting portion 21*a* pushed inside by the inclined face 242 of the protruding portion 241 slides in the opposite direction to the protruding direction and additionally the CRG stopper 21*b* moves in the retracting direction (direction of A in FIG. 4) for location at the retraction position, leading to such a state as illustrated in FIG. 7. In this case, due to the upper support member 23*a* and the lower support member 23*b*, the CRG stopper 21*b* is guided for movement in the retracting direction.

In this state, with no interference with the CRG stopper 21*b*, the guide protruding portion 56 can be inserted from above in the CRG guide 60. Thus, the process cartridge 50 is attached to the apparatus body 1*a*. As above, the blocking member 21 retracted due to a press by the cleaning unit 200 located at the retraction position enables attachment of the process cartridge 50 to the apparatus body 1*a*. Movement of the cleaning unit 200 and retraction of the blocking member 21 can be carried out with the operation portion 240.

Next, the operation of attachment of a process cartridge 50 to the apparatus body 1*a* with the cleaning unit 200 located at the cleaning position instead of the retraction position will be described.

First, the guide protruding portion 56 of the process cartridge 50 is inserted, from above, into a CRG guide 60 in the apparatus body 1*a*.

Then, the guide protruding portion 56 moves downward while being guided by the CRG guide 60. In this case, because the inclined face 242 of the protruding portion 241 does not abut on the inclined face 21*c* of the cleaning-unit detecting portion 21*a*, the cleaning-unit detecting portion 21*a* is not pushed inside. Therefore, the cleaning-unit detecting portion 21*a* does not slide in the opposite direction to the protruding direction and additionally the CRG stopper 21*b* is not retracted.

In this state, the guide protruding portion 56 abuts on the CRG stopper 21*b* due to interference with the CRG stopper 21*b*. Thus, the guide protruding portion 56 is not inserted, from above, in the CRG guide 60. Thus, the process cartridge 50 is not attached to the apparatus body 1*a*.

Such blocking members 21 as above are provided one-to-one at the CRG guides 60. Therefore, in a case where the cleaning unit 200 is located at the cleaning position in any of four process cartridges 50 guided, respectively, by four CRG guides 60, attachment of the process cartridge 50, of which the cleaning unit 200 is located at the cleaning position, is blocked by the blocking member 21.

As described above, the blocking member 21 slides and retracts, due to a press by the protruding portion 241, orthogonally to the direction of attachment of the process cartridge 50 to the apparatus body 1*a*, enabling attachment of the process cartridge 50 to the apparatus body 1*a*. Thus, the length of the apparatus body 1*a* in the direction of attachment can be shortened.

Provision of the spring 22 that applies a force to the blocking member 21 in the opposite direction to the retracting direction of the blocking member 21 enables reliable protrusion of the cleaning-unit detecting portion 21*a* from the attachment face 1*b*.

Protrusion of the cleaning-unit detecting portion 21*a* from the attachment face 1*b* of the apparatus body 1*a* between adjacent process cartridges 50 enables a reduction in the size of the apparatus body 1*a*.

Due to interference with the guide protruding portion 56 with the cleaning unit 200 located at the cleaning position, the blocking member 21 blocks attachment of the process cartridge 50 to the apparatus body 1*a*. Thus, with the cleaning unit 200 located at the cleaning position, the guide protruding portion 56 guided by the CRG guide 60 interferes with the blocking member 21.

According to the present embodiment, a cleaning unit 200 is attached to a process cartridge 50 and is capable of moving between the cleaning position for cleaning the charge wire 52 and the retraction position for retraction from the cleaning position. A blocking member 21 blocks attachment of the process cartridge 50 to the apparatus body 1*a* with the cleaning unit 200 located at the cleaning position, disabling attachment of the process cartridge 50 to the image forming apparatus 1. This leads to prevention of image deterioration, such as an image partially lost, based on any process cartridge 50 attached to the apparatus body 1*a*.

The present invention is not limited to the above embodiment, and thus various modifications can be made without departing from the gist of the invention.

Specifically, a slidable cleaning-unit detecting portion 21*a* is provided in the above embodiment, but this is not limiting. Thus, a turnable cleaning-unit detecting portion may be provided. In this case, in attachment of a process cartridge to the apparatus body, such a cleaning unit detecting portion turns due to a press by the operation portion of the cleaning unit, so that the CRG stopper 21*b* is retracted.

In the above embodiment, the image forming apparatus 1 is provided as a color printer (single function printer (SFP)), but this is not limiting. Thus, the image forming apparatus may include a reading unit at the upper portion of the apparatus body as a multi-function peripheral. In this case, the reading unit is turnable in order to open the CRG cover 11, so that a similar effect can be acquired.

In the above embodiment, a process cartridge 50 includes a photoconductive drum 51*y*, 51*m*, 51*c*, or 51*k*, a retainment roller 54, a charge unit 55, and a development roller 62. However, a process cartridge is required to include at least a charge unit 55.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-184723, filed Nov. 12, 2021, which is hereby incorporated by reference herein in its entirety.

What is claimed is:

1. An image forming apparatus comprising:

a process cartridge attachable to the image forming apparatus, the process cartridge including: a photoconductive drum; a charge member configured to charge the photoconductive drum; and a cleaning unit including: a cleaning member configured to clean the charge member; and an operation portion to be operated by a user in order to move the cleaning member between a cleaning position for cleaning the charge member and a retraction position for retraction from the cleaning position;

a guide portion configured to guide the process cartridge in a direction of attachment to the image forming apparatus;

a stopper configured to butt against the process cartridge guided in the direction of attachment by the guide portion, to restrict movement of the process cartridge in the direction of attachment; and a lever portion connected to the stopper, the lever portion being configured to move together with the stopper, wherein the stopper is movable between a first position that butts against the process cartridge guided in the direction of attachment by the guide portion and a second position that does not butt against the process cartridge guided in the direction of attachment by the guide portion, in a case where the cleaning member is located at the cleaning position in attachment of the process cartridge to the image forming apparatus, the stopper located at the first position butts against the process cartridge guided in the direction of attachment by the guide portion such that the process cartridge is disabled from being attached to the image forming apparatus, and in a case where the cleaning member is located at the retraction position in attachment of the process cartridge to the image forming apparatus, the lever portion moves due to a press by the cleaning unit and the stopper moves from the first position to the second position such that the process cartridge is enabled to be attached to the image forming apparatus.

2. The image forming apparatus according to claim 1, further comprising a biasing member configured to apply a force to the lever portion through the stopper, wherein in a case where the cleaning member is located at the cleaning position in attachment of the process cartridge to the image forming apparatus, the stopper located at the first position due to the force applied by the biasing member butts against the process cartridge guided in the direction of attachment by the guide portion such that the process cartridge is disabled from being attached to the image forming apparatus, and in a case where the cleaning member is located at the retraction position in attachment of the process cartridge to the image forming apparatus, due to a press by the cleaning unit to the lever portion having received the force applied by the biasing member, the stopper moves from the first position to the second position against the force applied by the biasing member such that the process cartridge is enabled to be attached to the image forming apparatus.

3. The image forming apparatus according to claim 1, further comprising a conveying member configured to convey a recording material, wherein the image forming apparatus forms an image on the recording material conveyed by the conveying member, and the lever portion is disposed between a plurality of the guide portions adjacent in a conveying direction of the recording material by the conveying member.

4. The image forming apparatus according to claim 1, further comprising a cover openably disposed for attachment of the process cartridge to or detachment of the process cartridge from the image forming apparatus, wherein the cover is located right above the process cartridge in a vertical direction, with the process cartridge attached to the image forming apparatus.

5. The image forming apparatus according to claim 1, wherein the process cartridge includes a development roller configured to bear and convey toner for development of an electrostatic latent image formed on the photoconductive drum.

* * * * *